US008919737B2

(12) United States Patent
Balder et al.

(10) Patent No.: US 8,919,737 B2
(45) Date of Patent: Dec. 30, 2014

(54) TRACTION DEVICE AND METHOD FOR PAYING OUT AND RETRIEVING A FLEXIBLE LINE

(75) Inventors: Thomas Balder, Leiden (NL); Cornelis Van Zandwijk, Waddinxveen (NL); Cornelis Benard, Vlaardingen (NL)

(73) Assignee: Heerema Marine Contractors Nederland B.V., Leiden (NL)

( * ) Notice: Subject to any disclaimer, the term of this patent is extended or adjusted under 35 U.S.C. 154(b) by 0 days.

(21) Appl. No.: 13/643,973

(22) PCT Filed: Apr. 28, 2011

(86) PCT No.: PCT/NL2011/050290

§ 371 (c)(1),
(2), (4) Date: Oct. 26, 2012

(87) PCT Pub. No.: WO2011/136650

PCT Pub. Date: Nov. 3, 2011

(65) Prior Publication Data

US 2013/0043448 A1 Feb. 21, 2013

Related U.S. Application Data

(60) Provisional application No. 61/329,166, filed on Apr. 29, 2010.

(30) Foreign Application Priority Data

Apr. 29, 2010 (NL) ..... 2004631

(51) Int. Cl.
*B66D 1/30* (2006.01)
*B66D 1/74* (2006.01)

(52) U.S. Cl.
CPC ..... *B66D 1/7405* (2013.01)
USPC ..... 254/371; 254/278

(58) Field of Classification Search
USPC ..... 254/278, 371–374, 388, 389
See application file for complete search history.

(56) References Cited

U.S. PATENT DOCUMENTS

| | | | | |
|---|---|---|---|---|
| 3,966,170 | A | 6/1976 | McKenna | |
| 4,169,535 | A | 10/1979 | Bryan, Jr. | |
| 4,236,696 | A | 12/1980 | Hicks et al. | |
| 6,182,915 | B1 | 2/2001 | Kvalsund et al. | |
| 7,537,087 | B2 * | 5/2009 | May | 182/142 |

FOREIGN PATENT DOCUMENTS

| | | | |
|---|---|---|---|
| DE | 682552 | C | 10/1939 |
| FR | 2377962 | A1 | 8/1978 |
| GB | 1031408 | A | 6/1966 |

* cited by examiner

*Primary Examiner* — Emmanuel M Marcelo
*Assistant Examiner* — Angela Caligiuri
(74) *Attorney, Agent, or Firm* — Hoffmann & Baron, LLP

(57) ABSTRACT

A traction device for paying out and retrieving a flexible line including a line mover, wherein the line mover includes at least one movable friction surface, the friction surface in total defines at least two arc sections configured to move the line along with the arc sections, in use the line is wound around the friction surface such that the line has a first contact area being in contact with the first arc section and a second contact area being in contact with the second arc section, and the traction device includes a line controller coupled to the line between the first contact area and the second contact area and configured to control the velocity with which the line in use is fed to the second arc section, and also a method and use of the traction device.

19 Claims, 12 Drawing Sheets

TRACTION DEVICE AND METHOD FOR PAYING OUT AND RETRIEVING A FLEXIBLE LINE

CROSS-REFERENCE TO RELATED APPLICATIONS

This application is the National Stage of International Application No. PCT/NL2011/050290, filed Apr. 28, 2011, based upon U.S. Application No. 61/329,166, filed Apr. 29, 2010, and Netherlands Application No. 2004631, filed Apr. 29, 2010, and incorporated in its entirety for the teachings therein.

FIELD OF THE INVENTION

The present invention relates to a traction device for paying out and retrieving a flexible line.

BACKGROUND OF THE INVENTION

The traction device includes a line mover. The line mover includes at least one movable friction surface. The friction surface in total defines at least two arc sections configured to move the line along with the arc sections. In use the line is wound around the friction surface such that the line includes a first contact area being in contact with the first arc section and a second contact area being in contact with the second arc section. Traction devices arc often used for paying out and retrieving a flexible line connected to a load, in general a heavy load. The flexible line may be a cable, rope, wire or the like.

The traction device may be used in any kind of hoisting system. In the situation that the traction device is located on a vessel, the traction device is often used for lowering or lifting heavy objects to or from the seabed. In this case one end of the line may be connected to the heavy object and the other end of the line may be connected to a winch for reeling in or out the line. The traction device is then coupled to the line between the winch and the heavy object. This means that the line runs from the winch, via the traction device to the heavy object. The traction device is coupled to the vessel and hears part of or substantially the full load during the lowering or lifting operation. Due to this the winch only bears the remaining part of the load during the lowering operation. This allows the lowering or lifting of very heavy objects to or from a seabed in a controllable manner.

U.S. Pat. No. 6,182,915 discloses a traction device including a line mover with multiple active rotation sheaves. Each active rotation sheave is drivable around a rotation axis and defines a friction surface with an arc section. Each active rotation sheave is provided with a separate driving unit to rotate the rotation sheave around the rotation axis thereof. This way the rotation speed of each rotation sheave can be optimized in relation to the velocity of the parts of the line being in contact with the different active rotation sheaves. This requires one or more very complex driving and control systems for controlling the rotation of the rotation sheaves. U.S. Pat. No. 6,182,915 also shows a further embodiment wherein the friction surfaces of the line mover arc formed by endless belts which are moveable along a track having the shape of a half circle.

An object of the traction device according the invention is to solve a problem of the prior art, or at least provide an alternative thereto.

SUMMARY OF THE INVENTION

The traction device according to the invention therefore includes a line mover, wherein the line mover includes at least one movable friction surface. The friction surface in total defines at least two arc sections configured to move the line along with the arc sections. In use the line is wound around the friction surface such that the line includes a first contact area being in contact with the first arc section and a second contact area being in contact with the second arc section. The traction device includes a line controller coupled to the line between the first contact area and the second contact area and configured to control the velocity with which the line in use is fed to the second arc section.

The invention further relates to a traction device as defined in the claims.

The invention further relates to a method of paying out and retrieving a flexible line with a traction device including a line mover, wherein the line mover includes at least one movable friction surface. The friction surface in total defines at least two arc sections configured to move the line along with the arc sections. The line is wound around the friction surface such that the line includes a first contact area being in contact with the first arc section and a second contact area being in contact with the second arc section. The traction device includes a line controller coupled to the line between the first contact area and the second contact area. The method includes controlling the velocity with which the line is fed to the second arc section by the line controller. The invention further relates to a method as defined in the claims.

The invention further relates to a hoisting system including a traction device according to the invention. The invention further relates to a vessel including a traction device according to the invention. The invention further relates to a crane including a traction device according to the invention. The invention further relates to a use of a traction device according to the invention. The invention further relates to a use of a hoisting system according to the invention. The invention further relates to a use of a vessel according to the invention. The invention further relates to a use of a crane according to the invention.

BRIEF DESCRIPTION OF THE DRAWINGS

Embodiments of the traction device and method according the invention will be discussed in more detail with reference to the accompanying drawings, wherein.

It is noted that in the FIGS. 1-12 the corresponding reference numbers relate to corresponding features.

DETAILED DESCRIPTION OF THE INVENTION

Figure 1:
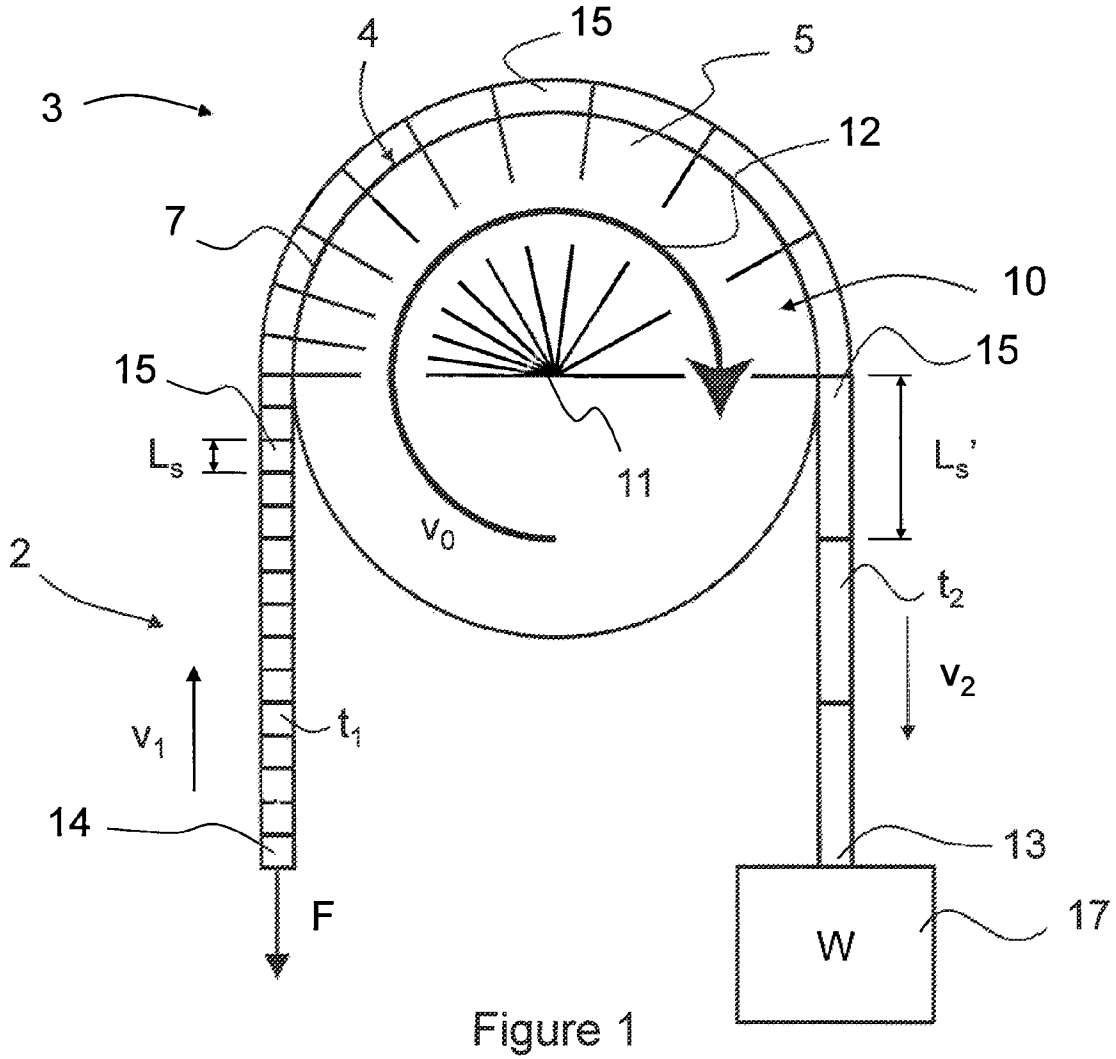
FIG. 1 schematically shows a side view of a line mover wherein a line is moved along with an arc section of a friction surface.

FIG. 1 shows a line mover 3. In the shown situation, a weight 17 is lowered with the use of the line mover 3. The line mover 3 is formed by an active rotation sheave 10. The active rotation sheave 10 is drivable around a rotation axis 11 and includes a friction surface 4 formed by the circumference thereof. The active rotation sheave 10 is rotatable as indicated by rotation arrow 12. The active rotation sheave 10 can be driven such that the friction surface 4 rotates at a predetermined velocity $v_0$ (meters/second). At a contact area 7 of the line 2, the line 2 is in contact with an arc section 5 of the friction surface 4. Due to the friction between the friction surface 4 and the line 2 in the contact area 7, the line 2 moves along with the arc section 5 of the friction surface 4 when the line mover 3 is rotated.

The weight 17 is connected to a first end 13 of the line 2. A force F is subjected to a second end 14 of the line 2 to make sure that the line 2 does not slip over the friction surface 4 while the weight is being lowered. Due to the fact that the friction surface 4 of the line mover 3 exerts a friction force to the line 2, the line mover 3 bears part of the force subjected to the line 2 by the weight 17. This means that the part of the line 2 extending between the first end 13 and the contact area 7 is subjected to a tensile stress $t_2$ which is larger than the tensile stress $t_1$ in the part of the line 2 extending between the second end 14 and the contact area 7.

Each type of line 2 used has a specific tensile elasticity (Young's modulus). This is often referred to as the elastic modulus and defines the ratio between the tensile stress to which the line is subjected and the strain of the line as a result of said stress. The larger stress in the part of the line 2 extending between the first end 13 and the contact area 7 will result in a larger strain when compared to the strain in the part of the line 2 extending between the second end 14 and the contact area 7. This is indicated in the FIG. 1 by the different lengths ($L_s$ and $L_s'$) of line sections 15 of line 2.

When lowering the weight 17, the part of the line 2 extending between the second end 14 and the contact area 7 is fed to the arc section 5 with a velocity $v_1$ (meters/second). When a line section 15 goes through the contact area 7 it is subjected to an increasing additional load, which will result in an increasing additional strain. As the strain in the line sections 15 of the line 2 increases, the velocity with which said line 2 moves also increases. As a result of this, the line 2 is discharged from the contact area 7 with a velocity $v_2$ which is higher than the velocity $v_1$.

Speed differences between the line 2 in the contact area 7 and the friction surface 4 in the arc section 5 at a certain point will result in slipping of the line 2. In turn this will lead to highly unwanted wear of the line 2. It is therefore desired to minimize said speed differences in order to minimize the wear of the line 2.

In the situation that a traction device includes several contact areas 7, the above described phenomenon occurs at each contact area. This means that in this situation the velocity of the line 2 increases each time the line 2 goes through one of the contact areas 7.

In U.S. Pat. No. 6,182,915 the speed differences between the contact areas of the line and the friction surface of the arc sections is minimized by a driving and control system wherein each active rotation sheave has an independent driving unit and the speed of the friction surface of each active rotation sheave is adjusted to the speed of the part of the line coming in contact with the rotation sheave. This means that the traction device of U.S. Pat. No. 6,182,915 has a very complex driving and control system for controlling the rotation of the active rotation sheaves.

Figure 2:
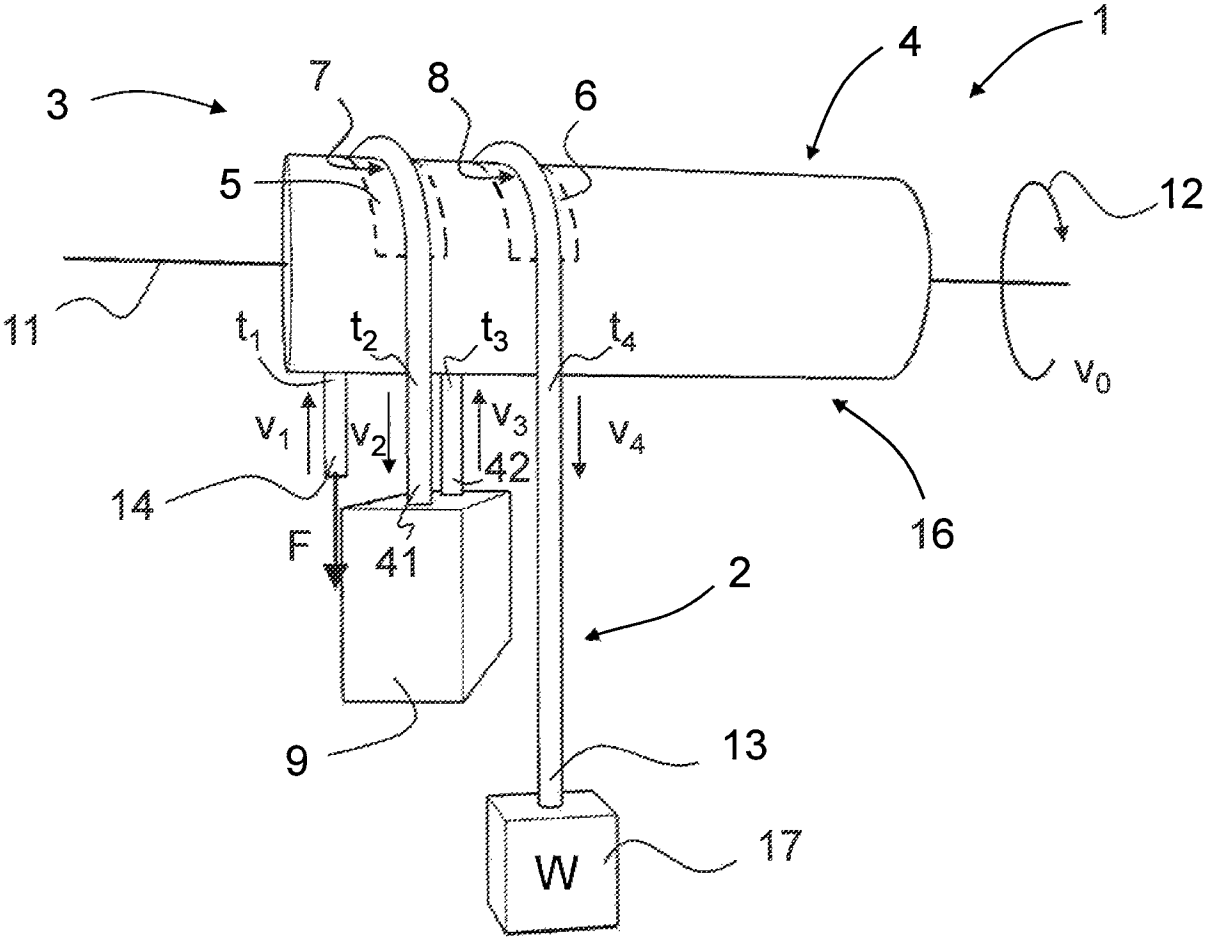
FIG. 2 schematically shows a first embodiment of a traction device according to the invention.

FIG. 2 shows a first embodiment of a traction device 1 according to the invention. In the shown situation, a weight 17 is lowered with the use of the traction device 1. The traction device 1 for paying out and retrieving a flexible line 2 includes a line mover 3. The line mover 3 includes one movable friction surface 4. The friction surface 4 is formed by the circumference of a rotation drum 16. The rotation drum 16 is drivable in a rotary manner around a rotation axis 11. The rotation axis 11 substantially coincides with the longitudinal axis of the rotation drum 16. The friction surface 4 defines a first arc section 5 and a second arc section 6 configured to move the line 2 along with the arc sections 5 and 6. The first arc section 5 and second arc section 6 are indicated by discontinuous lines. The first arc section 5 and second arc section 6 may also be formed by two separate friction surfaces, such as two active rotation sheaves coupled to one rotation axis 11.

The line 2 is wound around the friction surface 4 such that the line 2 includes a first contact area 7 being in contact with the first arc section 5 and a second contact area 8 being in contact with the second arc section 6. The traction device 1 includes a line controller 9 coupled to the line 2 between the first contact area 7 and the second contact area 8 and configured to control the velocity $v_3$ with which the line 2 in use is fed to the second arc section 6.

The rotation drum 16 is driven in a rotary manner such that the friction surface 4 moves with a specific velocity $v_o$ (meters/second) as indicated by rotation arrow 12. The line 2 is fed to the first arc section 5 with a velocity $v_1$ (meters/second). The velocity $v_1$ is chosen such to minimize the wear between the line 2 in the first contact area 7 and the friction surface 4 in the first arc section 5. The line 2 is discharged from the first arc section 5 with a velocity $v_2$ (meters/second). As indicated before, due to the additional strain of the line 2 when going through the first contact area 7, the velocity $v_2$ is higher than the velocity $v_1$.

The part of the line 2 discharged from the first arc section 5 is fed to the line controller 9. The line controller 9 feeds the line 2 to the second arc section 6 with a velocity $v_3$ (meters/second) which differs from $v_2$. This way the line 2 can be fed to the second arc section 6 at such a velocity $v_3$ that the before mentioned speed differences between the line 2 in the second contact area 8 and the friction surface 4 in the second arc section 6 are minimized in order to minimize the wear of the line 2. In this situation $v_3$ will be lower than $v_2$ and substantially equal to $v_1$. The line 2 is discharged from the second arc section 6 with a velocity $v_4$ (meters/second), which is higher than the velocity $v_3$.

The line controller 9 is configured to control the length of the line 2 extending between the first contact area 7 and the second contact area 8. This is the result of the fact that the line controller 9 feeds the line 2 to the second arc section 6 with a velocity $v_3$ (meters/second) which differs from the velocity $v_2$ with which the line is discharged from the first arc section 5.

The line controller 9 is configured to exert such a force to the part of the line 2 extending between the first contact area 7 and the second contact area 8 that the line 2 at the first contact area 7 and second contact area 8 does substantially not slip over the first arc section 5 and the second arc section 6, respectively.

The stress in the part of line 2 extending between the second end 14 and the first contact area 7 is indicated by $t_1$.

The stress in the part of line 2 extending between the first contact area 7 and the line controller 9 is indicated by $t_2$. The stress in the part of line 2 extending between the line controller 9 and the second contact area 8 is indicated by $t_3$. The stress in the part of line 2 extending between the second contact area 8 and the first end 13 is indicated by $t_4$. The line controller 9 is configured to control the stress in the part of the line extending between the first contact area 7 and the second contact area 8.

For the line controller 9 the part of line 2 extending between the first contact area 7 and the line controller 9 is an incoming line 41 and the part of line 2 extending between the second contact area 8 and the line controller 9 is an outgoing line 42. The line controller 9 is configured to maintain the stress in the outgoing line 42 ($t_3$) substantially equal to the stress in the incoming line 41 ($t_2$). It is noted that in operation, the line controller 9 always will have to deal with a certain amount of internal friction and for that reason the stress in the outgoing line 42 ($t_3$) will in practise never be completely equal ($t_3=t_2$) to the stress in the incoming line 41 ($t_2$).

This means that the following relations for the velocities and stresses in the line 2 apply.

| | | | |
|---|---|---|---|
| Velocity: | $v_2 > v_1$ | $v_3 \approx v_1$ | $v_4 > v_3$ |
| Stress: | $t_2 > t_1$ | $t_3 \approx t_2$ | $t_4 > t_3$ |

The traction device 1 according the invention has a simple construction. The traction device 1 can in use reduce the wear of the line 2. The traction device 1 may be used with any type of line 2. The traction device 1 is specifically advantageous when used with a type of line 2 having a relatively small Young's modulus. This type of line may comprise a synthetic material as for example a synthetic fiber line.

This allows the use of a line comprising UHMWPE (Ultra High Molecular Weight Polyethylene), LCP (Liquid Crystal Polymer) or Aramides (and also combinations thereof). An advantage of these lines is that they have the same strength as steel lines but are much lighter. The weight of steel lines causes many problems when a heavy object is lowered over a large distance. This occurs for example during the lowering of a heavy object from a vessel to a seabed at a depth of 3000 meters. During such lowering operations, the weight of a fully lowered steel line is larger than the weight of the heavy object. Examples of UHMWPE are Dyneema®, Plasma®, Spectra®, Certran® and Tensylon®. Examples of Aramide are Kevlar®, Twaron®, Technora® and Nomex®. Examples of LCP are Vectran® and M5®.

Figure 3:
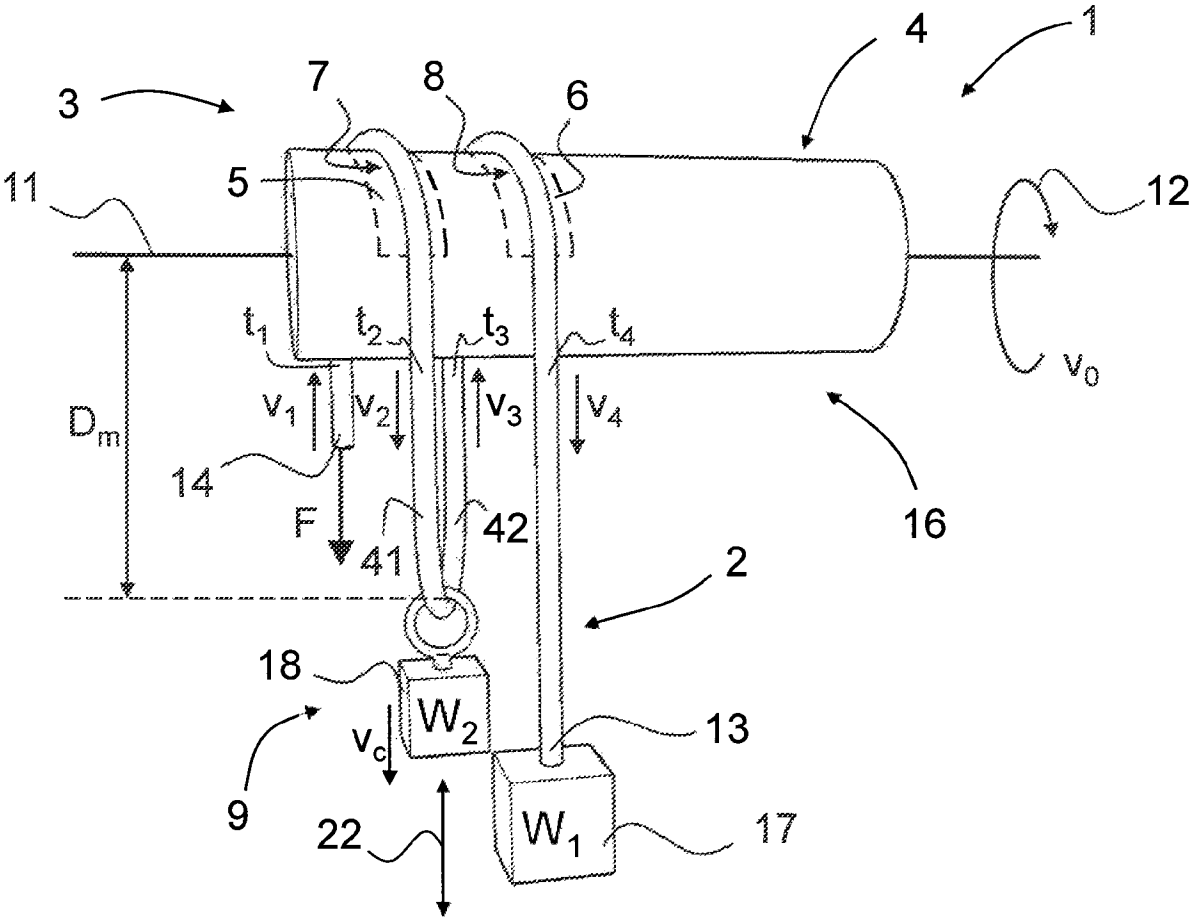
FIG. 3 schematically shows a second embodiment of a traction device according to the invention.

FIG. 3 shows a second embodiment of a traction device 1 according to the invention. In the shown situation, a first weight 17 is lowered with the use of the traction device 1. The same relations as indicated for FIG. 2 apply for the velocities ($v_1$, $v_2$, $v_3$, $v_4$) and stresses ($t_1$, $t_2$, $t_3$, $t_4$) of the line 2.

The line controller 9 adjusts the length of the part of the line 2 extending between the first contact area 7 and the second contact area 8. The first weight 17 is connected to the first end 13 of the line 2. The line controller 9 comprises a weight member (hereafter referred to as second weight 18) coupled to the line 2 between the first contact area 7 and the second contact area 8. The second weight 18 is freely movable along the line 2. The second weight 18 is movable in the direction of moving arrow 22. In this embodiment the second weight 18 is movable towards and away from the line mover 3. More specifically, the second weight 18 is movable towards and away from the first arc section 5 and the second arc section 6.

The second weight 18 exerts such a force to the part of the line 2 extending between the first contact area 7 and the second contact area 8 that the line 2 at the first contact area 7 and second contact area 8 does substantially not slip over the first arc section 5 and the second arc section 6, respectively.

The magnitude of the force of the second weight 18 working on the line 2 determines the velocity $v_3$ with which the line 2 is fed to the second arc section 6. By adjusting the force (for example by adjusting the mass of the second weight 18) the velocity $v_3$ can be adjusted. The mass of the second weight 18 is chosen such that the speed differences between the line 2 in the second contact area 8 and the friction surface 4 in the second arc section 6 are minimized in order to minimize the wear of the line 2.

In the situation shown, the mass of the second weight 18 is chosen such that $v_3$ substantially equals $v_1$. The velocity $v_3$ is smaller than the velocity with which the line 2 is discharged from the first contact area 7 (which is velocity $v_2$). Due to this, the length of the part of the line 2 extending between the first contact area 7 and the second contact area 8 increases. As result of this, the second weight 18 moves away from the line mover 3 with a velocity $v_c$.

Figure 4:
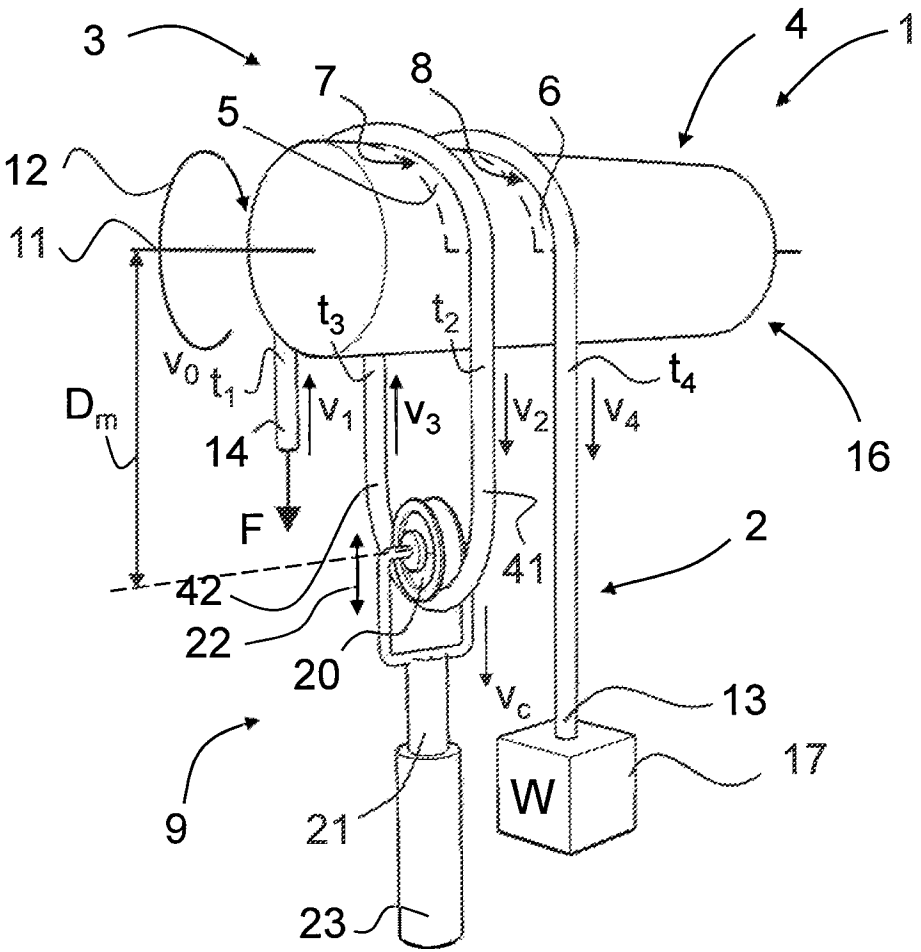
FIG. 4 schematically shows a third embodiment of a traction device according to the invention.

FIG. 4 shows a third embodiment of a traction device according to the invention. In the shown situation, a first weight 17 is lowered with the use of the traction device 1. The same relations as indicated for FIG. 2 apply for the velocities ($v_1$, $v_2$, $v_3$, $v_4$) and stresses ($t_1$, $t_2$, $t_3$, $t_4$) of the line 2.

The line controller 9 comprises a movable passive rotation sheave 20 coupled to the line 2 between the first contact area 7 and the second contact area 8. The passive rotation sheave 20 is substantially freely rotatable. The passive rotation sheave 20 is movable in the direction of moving arrow 22. Is this embodiment the passive rotation sheave 20 is movable towards and away from the line mover 3. More specifically, the passive rotation sheave 20 is movable towards and away from the first arc section 5 and the second arc section 6.

The passive rotation sheave 20 is moved by a sheave mover 21 connected to the passive rotation sheave 20. The sheave mover 21 is configured to exert such a force to the part of the line 2 extending between the first contact area 7 and the second contact area 8 that the line 2 at the first contact area 7 and second contact area 8 does substantially not slip over the first arc section 5 and the second arc section 6, respectively. The sheave mover 21 adjusts the distance $D_m$ between the line mover 3 and the passive rotation sheave 20. The force of the sheave mover 21 working on the line 2 via the passive rotation sheave 20 is controlled by a sheave control 23. The sheave mover 21 includes a hydraulic cylinder.

The passive rotation sheave 20 is moved with a velocity $V_c$. The movement of the passive rotation sheave 20 determines the velocity $v_3$ with which the line 2 is fed to the second arc section 6. The velocity $v_3$ is chosen such that the speed differences between the line 2 in the second contact area 8 and the friction surface 4 in the second arc section 6 are minimized in order to minimize the wear of the line 2.

Figure 5:
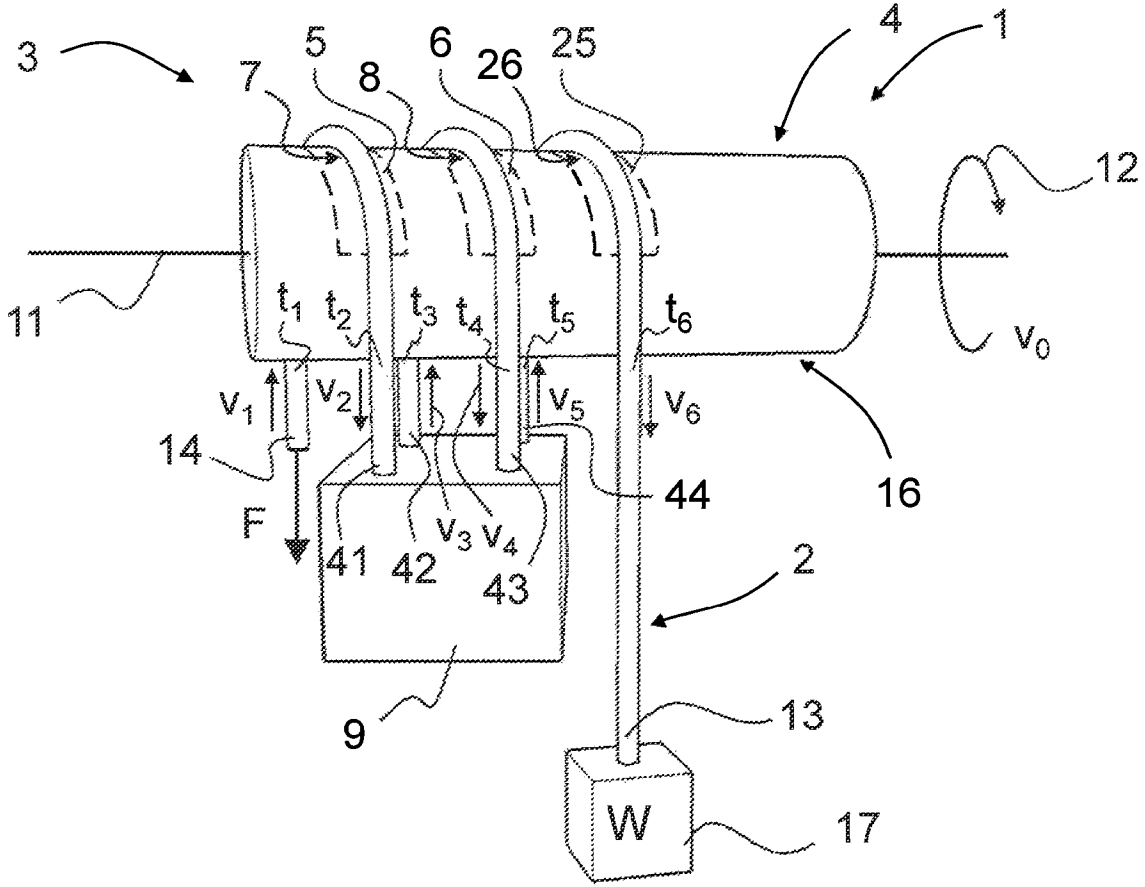
FIG. 5 schematically shows a fourth embodiment of a traction device according to the invention.

FIG. 5 shows a fourth embodiment of a traction device according to the invention. In the shown situation, a first weight 17 is lowered with the use of the traction device 1. In addition to the first and second arc section 5 and 6, the friction surface 4 of the rotation drum 16 defines a third arc section 25. The line 2 is wound such that in addition to the first and second contact area 7 and 8, the line 2 includes a third contact area 26 which is in contact with the third arc section 25.

The rotation drum 16 is driven in a rotary manner at a specific angular velocity $v_o$. The line 2 is fed to the first arc section 5 with a velocity $v_1$ and discharged from the first arc section 5 with a velocity $v_2$. Due to the additional strain to which the line 2 is subjected when going through the first contact area 7, the velocity $v_2$ is higher than the velocity $v_1$.

The part of the line 2 discharged from the first arc section 5 (the first incoming line 41) is fed to the line controller 9. The line controller 9 feeds the line 2 to the second arc section 6 (the first outgoing line 42) with a velocity $v_3$ which differs from $v_2$. This way the line 2 can be fed to the second arc section 6 at such a velocity $v_3$ that speed differences between the line 2 in the second contact area 8 and the friction surface 4 in the second arc section 6 are minimized in order to minimize the wear of the line 2. The velocity $v_3$ substantially equals $v_1$.

The line 2 is discharged from the second arc section 6 with a velocity $v_4$. Due to the additional strain to which the line 2 is subjected when going through the second contact area 8, the velocity $v_4$ of the line 2 is higher than the velocity $v_3$. The part of the line 2 discharged from the second arc section 6 (second incoming line 43) is fed to the line controller 9. The line controller 9 feeds the line 2 to the third arc section 25 (the second outgoing line 44) with a velocity $v_5$ which differs from $v_4$. This way the line 2 can be fed to the second arc section 25 at such a velocity $v_5$ that speed differences between the line 2 in the third contact area 26 and the friction surface 4 in the third arc section 25 are minimized in order to minimize the wear of the line 2. The velocity $v_5$ substantially equals $v_1$.

The line 2 is discharged from the third arc section 25 with a velocity $v_6$. Due to the additional strain to which the line 2 is subjected when passing the third contact area 26, the velocity $v_6$ is higher than the velocity $v_5$.

This means that the flowing relations for the velocities and stresses in the line 2 apply:

| | | | | | |
|---|---|---|---|---|---|
| Velocity: | $v_2 > v_1$ | $v_3 \approx v_1$ | $v_4 > v_3$ | $v_5 \approx v_1$ | $v_6 > v_5$ |
| Stress: | $t_2 > t_1$ | $t_3 \approx t_2$ | $t_4 > t_3$ | $t_5 \approx t_4$ | $t_6 > t_5$ |

This means that the line controller is able to control the velocity ($v_3$) with which the line in use is fed to the second arc section, and the velocity ($v_5$) with which the line in use is fed to the third arc section independent from each other. This is required because each arc section exerts a different friction force to the line. This is caused by the fact that the friction force strongly depends on the force with which the line is pulled against the arc section. The pulling force is different in each arc section.

Figure 6:
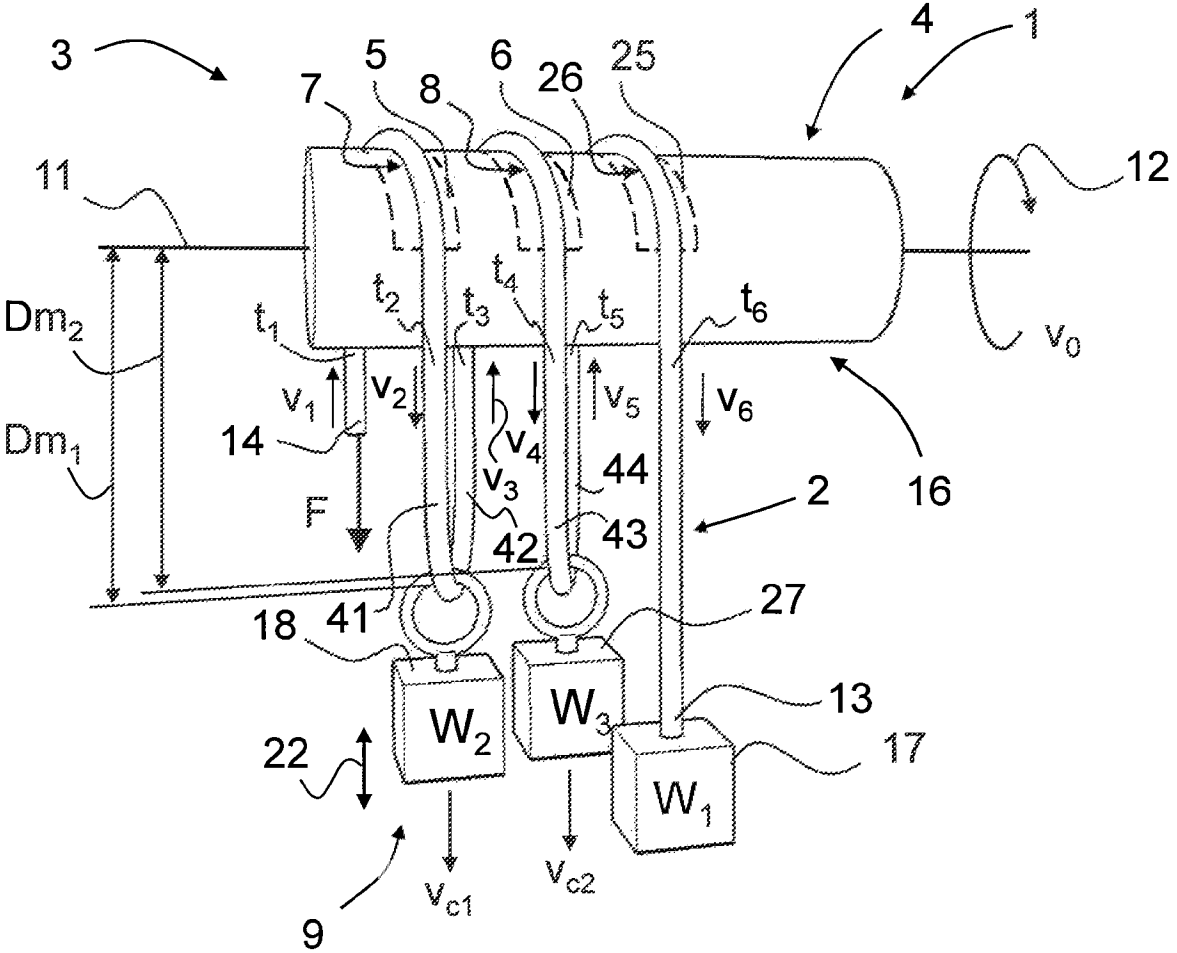
FIG. 6 schematically shows a fifth embodiment of a traction device according to the invention.

FIG. 6 shows a fifth embodiment of a traction device according to the invention. In the shown situation, a first weight 17 is lowered with the use of the traction device 1. The same relations as indicated for FIG. 5 apply for the velocities ($v_1$, $v_2$, $v_3$, $v_4$, $v_5$, $v_6$) and stresses ($t_1$, $t_2$, $t_3$, $t_4$, $t_5$, $t_6$) of the line 2.

The line controller 9 includes a weight member (indicated as second weight 18) coupled to the line 2 between the first contact area 7 and the second contact area 8, and a weight member (indicated as third weight 27) coupled to the line 2 between the second contact area 8 and the third contact area 26. The second weight 18 and the third weight 27 are freely movable. The second weight 18 and the third weight 27 are freely movable in the direction of moving arrow 22. In this embodiment the second weight 18 and the third weight 27 are movable towards and away from the line mover 3.

The second weight 18 subjects a force to the part of the line 2 extending between the first contact area 7 and the second contact area 8 such that the line 2 at the first contact area 7 and second contact area 8 does substantially not slip over the first arc section 5 and the second arc section 6, respectively. The third weight 27 subjects a force to the part of the line 2 extending between the second contact area 8 and the third contact area 25 such that the line 2 at the second contact area 8 and third contact area 26 does substantially not slip over the second arc section 6 and the second arc section 25, respectively.

The mass of the second weight 18 and the third weight 27 determine the velocities $v_3$ and $v_5$, respectively. By adjusting the mass of the second weight 18 and the third weight 27, the velocities $v_3$ and $v_5$ can be controlled, respectively. The mass of the second weight 18 and the third weight 27 is chosen such that the speed differences between the line 2 in the second contact area 8 and the friction surface 4 in the second arc section 6 and between the line 2 in the third contact area 25 and the friction surface 4 in the third arc section 26 are minimized in order to minimize the wear of the line 2.

In the situation shown, the mass of the second weight 18 and the third weight 27 is chosen such that $v_3$ is smaller then $v_2$ and $v_5$ is smaller then $v_4$. As result of this, the second weight 18 and the third weight 27 move with a velocity $v_{c1}$ and $v_{c2}$, respectively.

Figure 7:
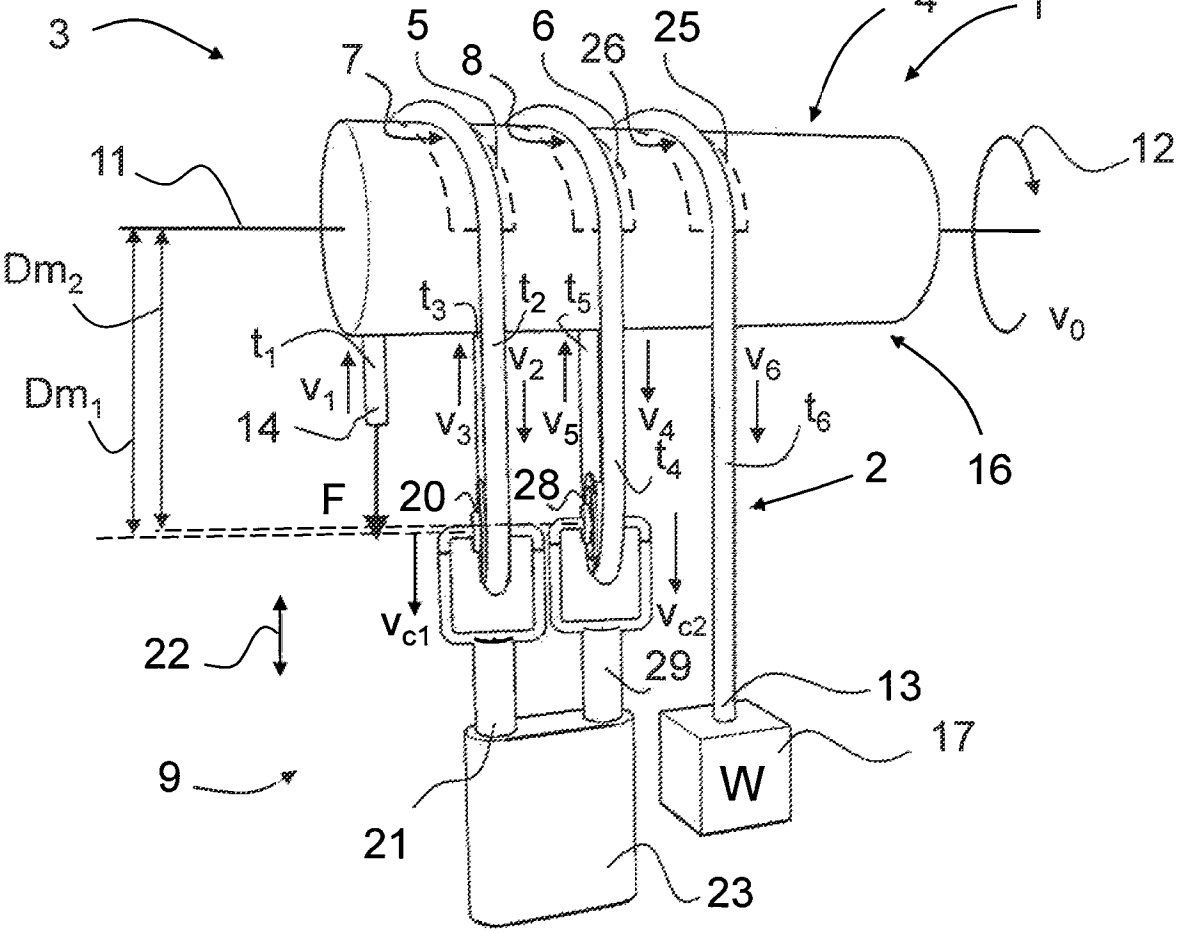
FIG. 7 schematically shows a sixth embodiment of a traction device according to the invention.

FIG. 7 shows a sixth embodiment of a traction device according to the invention. In the shown situation, a first weight 17 is lowered with the use of the traction device 1. The same relations as indicated for FIG. 5 apply for the velocities ($v_1$, $v_2$, $v_3$, $v_4$, $v_5$, $v_6$) and stresses ($t_1$, $t_2$, $t_3$, $t_4$, $t_5$, $t_6$) of the line 2.

The line controller 9 includes a first movable passive rotation sheave 20 coupled to the line 2 between the first contact area 7 and the second contact area 8 and a second movable passive rotation sheave 28 coupled to the line 2 between the second contact area 8 and the third contact area 26. The passive rotation sheaves 20 and 28 are substantially freely rotatable. The passive rotation sheaves 20 and 28 are movable in the direction of moving arrow 22.

The first passive rotation sheave 20 is moved by a first sheave mover 21 and second movable passive rotation sheave 28 is moved by a second sheave mover 29. The movements of the first sheave mover 21 and the second sheave mover 29 are controlled by a sheave control 23. The distance $D_{m1}$ between the first passive rotation sheave 20 and the line mover 3 and the distance $D_{m2}$ between the second rotation sheave 28 and the line mover 3 are independently adjustable.

The first sheave mover 21 is configured to exert such a force to the part of the line 2 extending between the first contact area 7 and the second contact area 8 that the line 2 in the first contact area 7 and the second contact area 8 does substantially not slip over the first arc section 5 and the second arc section 6, respectively. The second sheave mover 29 is configured to exert such a force to the part of the line 2 extending between the second contact area 8 and the third contact area 26 that the line 2 at the second contact area 8 and third contact area 26 does substantially not slip over the second arc section 6 and the third arc section 25, respectively. Each of the first and second sheave mover 21, 29 includes a hydraulic cylinder.

By controlling the movements of the first passive rotation sheave 20 and the second passive rotation sheave 28 the velocities $v_3$ and $v_5$ are controlled, respectively.

In the situation shown, the forces of the first sheave mover 21 and the second rotation sheave mover 29 is chosen such that $v_3$ is smaller than $v_2$ and $v_5$ is smaller than $v_4$. Due to this, the length of the part of the line 2 extending between the first contact area 7 and the second contact area and the length of the part of the line 2 extending between the second contact area 8 and the third contact area 26 increase. As result of this, the first passive rotation sheave 20 and the second passive rotation sheave 28 move with a velocity $v_{ci}$ and $v_a$, respectively. As shown in this figure, the passive rotation sheaves 20 and 29 move away from the line mover 3.

Figure 8:
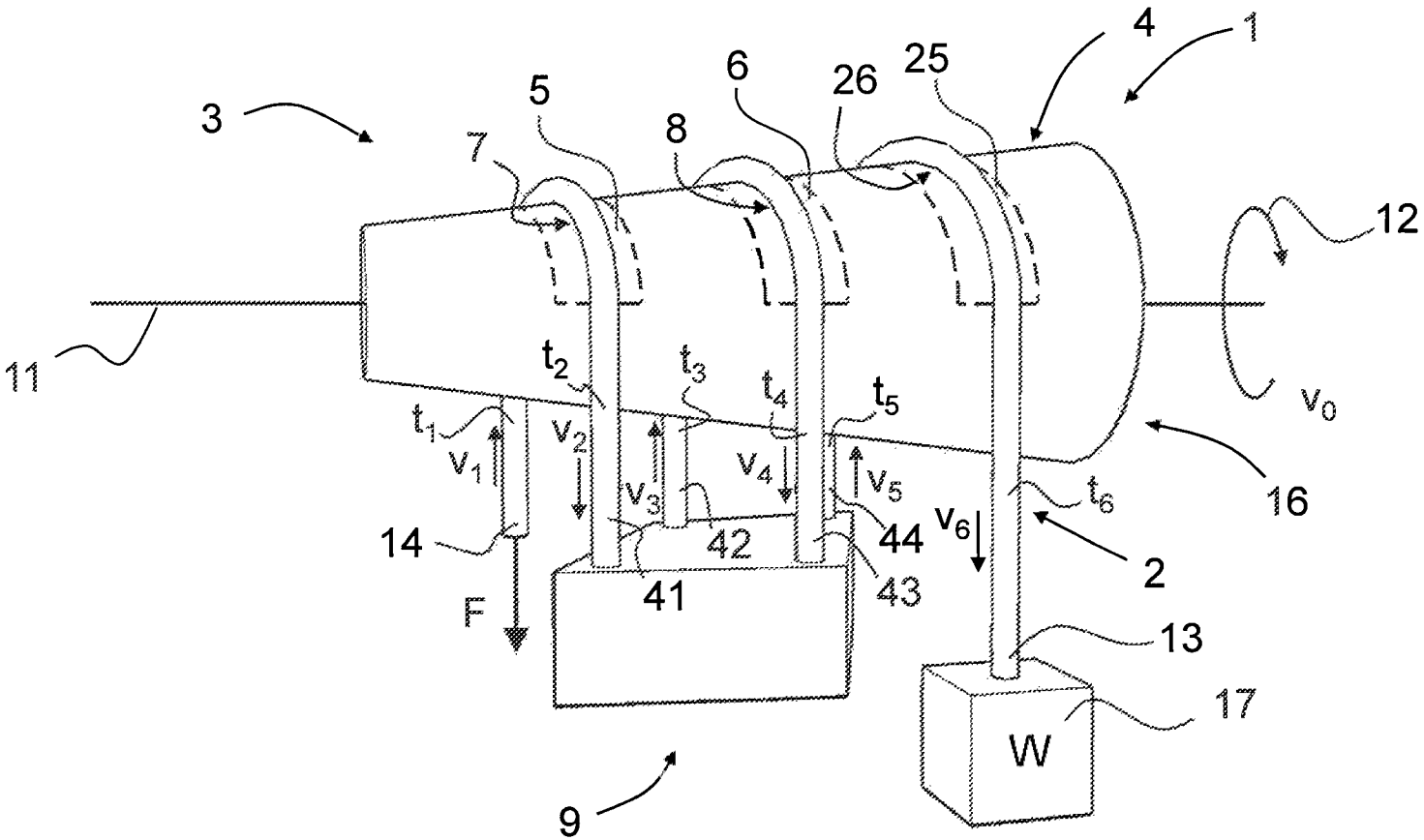
FIG. 8 schematically shows a seventh embodiment of a traction device according to the invention.

FIG. 8 shows a seventh embodiment of a traction device according to the invention. In the shown situation, a first weight 17 is lowered with the use of the traction device 1.

The rotation drum 16 of the traction device 1 includes a conical shape. The longitudinal axis of the conical shaped rotation drum 16 substantially coincides with the rotation axis 11. Due to the conical shape, the velocity with which the line mover 3 moves the line 2 in the second contact area 8 is larger than in the first contact area 7. The velocity with which the line mover 3 moves the line 2 in the third contact area 26 is larger than in the second contact area 8.

The flowing relations for the velocities and stresses in the line 2 apply.

| | | | | | |
|---|---|---|---|---|---|
| Velocity: | $v_2 > v_1$ | $v_2 > v_3 > v_1$ | $v_4 > v_3$ | $v_4 > v_5 > v_3$ | $v_6 > v_5$ |
| Stress: | $t_2 > t_1$ | $t_3 \approx t_2$ | $t_4 > t_3$ | $t_5 \approx t_4$ | $t_6 > t_5$ |

Figure 9:
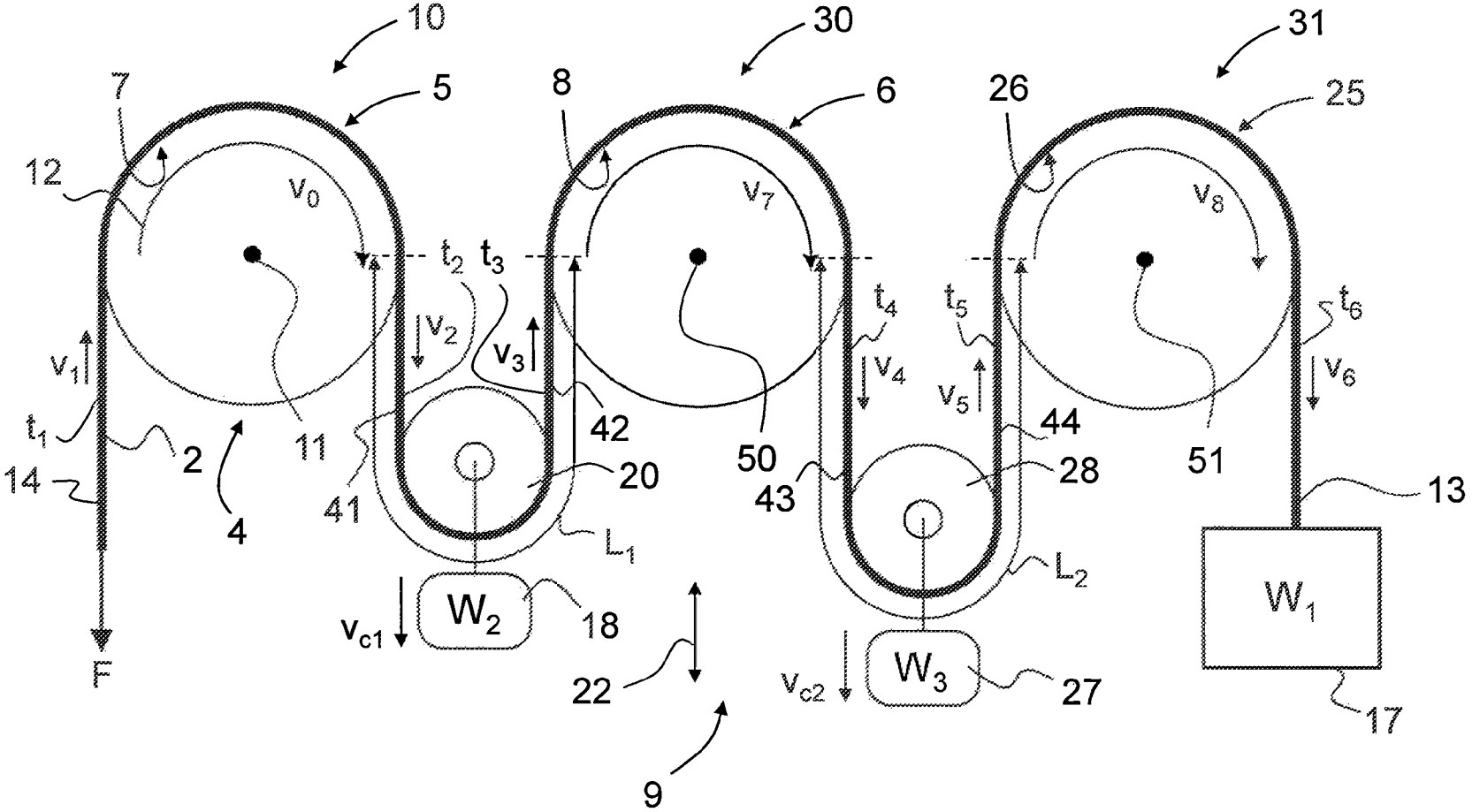
FIG. 9 schematically shows an eighth embodiment of a traction device according to the invention.

FIG. 9 shows an eighth embodiment of a traction device according to the invention. In the shown situation, a first weight 17 is lowered with the use of the traction device 1. The same relations as indicated for FIG. 5 apply for the velocities ($v_1$, $v_2$, $v_3$, $v_4$, $v_5$, $v_6$) and stresses ($t_1$, $t_2$, $t_3$, $t_4$, $t_5$, $t_6$) of the line 2.

The line mover 3 includes three active rotation sheaves 10, 30 and 31. The three active rotation sheaves 10, 30 and 31 are of the same size. Each active rotation sheave 10, 30 and 31 is driven about a rotation axis 11, 50, 51. The first active rotation sheave 10 defines a first arc section 5 and is driven in a rotary manner such that the friction surface 4 thereof rotates with a velocity $v_0$ (meters/second). The second active rotation sheave 30 defines a second arc section 6 and its friction surface 4 rotates with a velocity $v_7$ (meters/second). The third active rotation sheave 31 defines a third arc section 25 and its friction surface rotates with a velocity $v_8$ (meters/second). The velocities $v_0$, $v_7$ and $v_8$ are substantially equal to each other. In a further embodiment, the velocities $v_0$, $v_7$ and $v_8$ may differ from each other.

A first weight 17 is connected to a first end 13 of the line 2. The line controller 9 includes a first passive rotation sheave 20 coupled to the line 2 between the first contact area 7 and the second contact area 8. A second weight 18 is connected to the first passive rotation sheave 20. The line controller 9 further includes a second passive rotation sheave 28 coupled to the line 2 between the second contact area 8 and the third contact area 26. A third weight 28 is connected to the second passive rotation sheave 28. The first passive rotation sheave 20 and the second passive rotation sheave 28 are freely movable in the direction of arrow 22.

The length of the part of the line 2 extending between the first contact area 7 and the second contact area 8 is indicated by $L_1$. The length of the part of the line 2 extending between the second contact area 8 and the third contact area 26 is indicated by $L_2$.

The active rotation sheaves 10, 30 and 31 may be positioned in many different compositions. The active rotation sheaves 10, 30 and 31 may be positioned such that their rotation axes 11, 50, 51 substantially coincide. The active rotation sheaves 10, 30 and 31 may be centrally driven.

It is noted that it will be clear that the traction device 1 according to the invention also may include more than three arc sections 5, 6, 25 and corresponding contact areas 7, 8 and 26.

Figure 10:
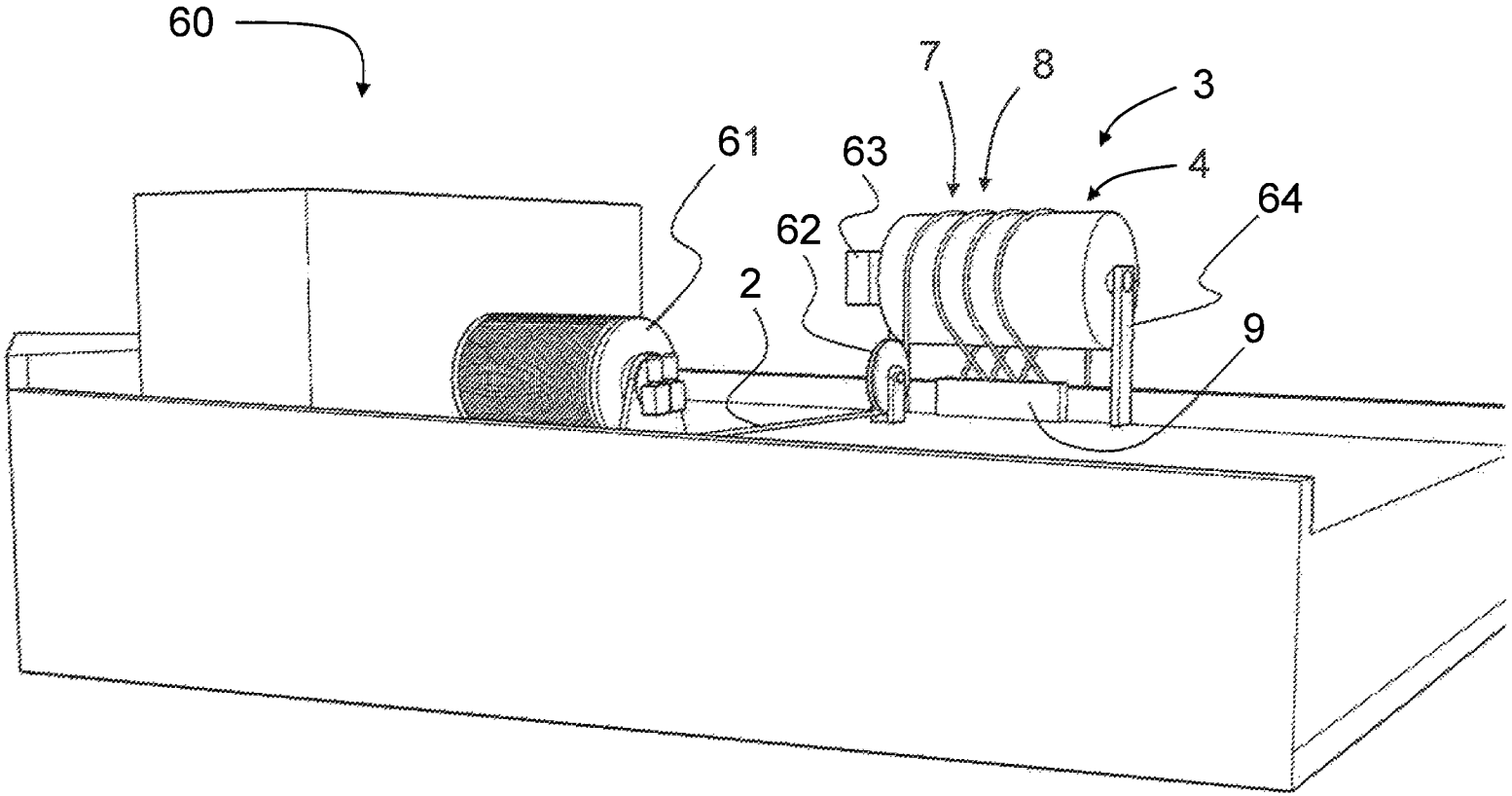
FIG. 10 schematically shows a vessel including a traction device according to the invention.

FIG. 10 shows a vessel 60 including a traction device 1 according to the invention. A line mover 3 is supported by the deck of the vessel 60 via a support structure 64. A line 2 is stored on a storage winch 61, from which the line 2 is routed via sheave 62 towards the line mover 3. The line mover 3 is drivable in a rotary manner by drive 63. The line 2 extends such that the line 2 forms several loops around the friction surface 4 of the line mover 3, while defining a contact area 7, 8 with each part of the loop being in contact with the friction surface 4 of the line mover 3. The line 2 extends from one of the contact areas 7 via the line controller 9 to the subsequent contact area 8. The line controller 9 controls the velocity with which the line is fed to the contact areas. The line 2 extends from the line mover 3 to a position outside the deck of the vessel 60. The storage winch 61 is located at a side of the vessel 60. The storage winch 61 may be located at a different location on the vessel 60, such as the stern of the vessel 60.

Figure 11:
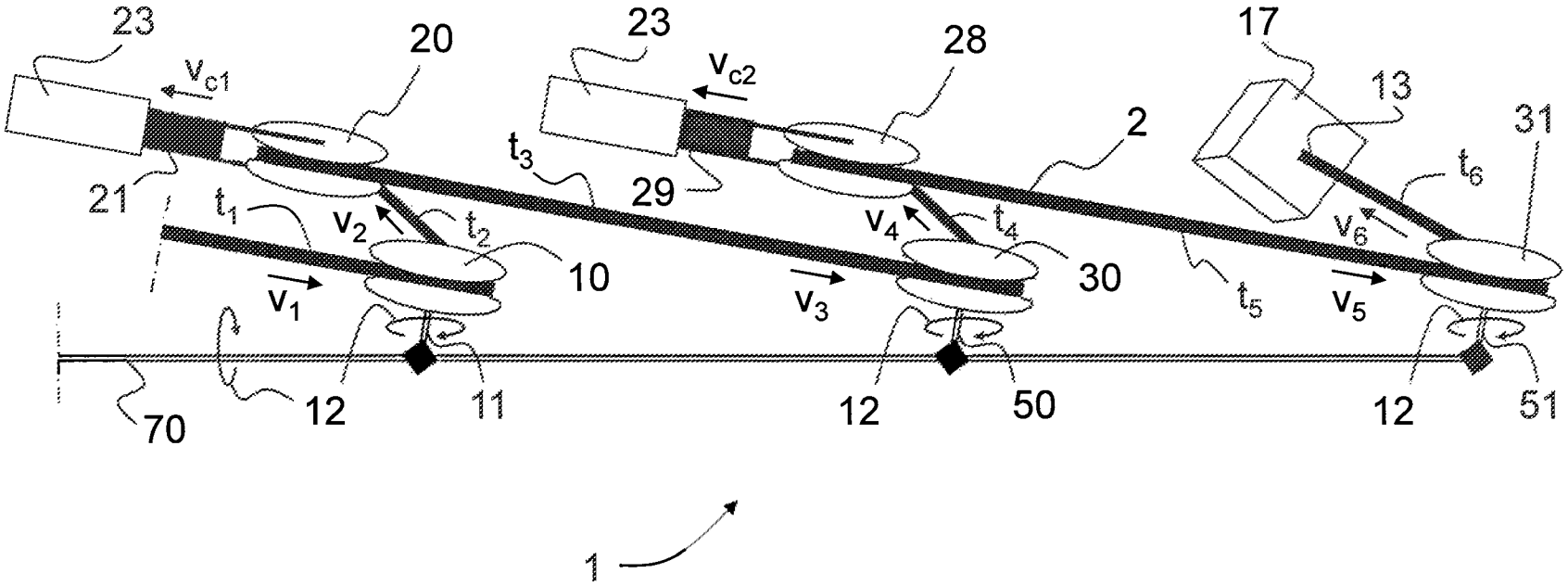
FIG. 11 schematically shows a ninth embodiment of a traction device according to the invention.

FIG. 11 shows a ninth embodiment of a traction device according to the invention. The traction device 1 includes a linear setup. The same relations as indicated for FIG. 5 apply for the velocities ($v_1$, $v_2$, $v_3$, $v_4$, $v_5$, $v_6$) and stresses ($t_1$, $t_2$, $t_3$, $t_4$, $t_5$, $t_6$) of the line 2. The active rotation sheaves 10, 30 and 31 are driven by a common driveshaft 70 such that said sheaves 10, 30 and 31 are rotated around the rotation axis 11, 50, 51, respectively.

Figure 12:
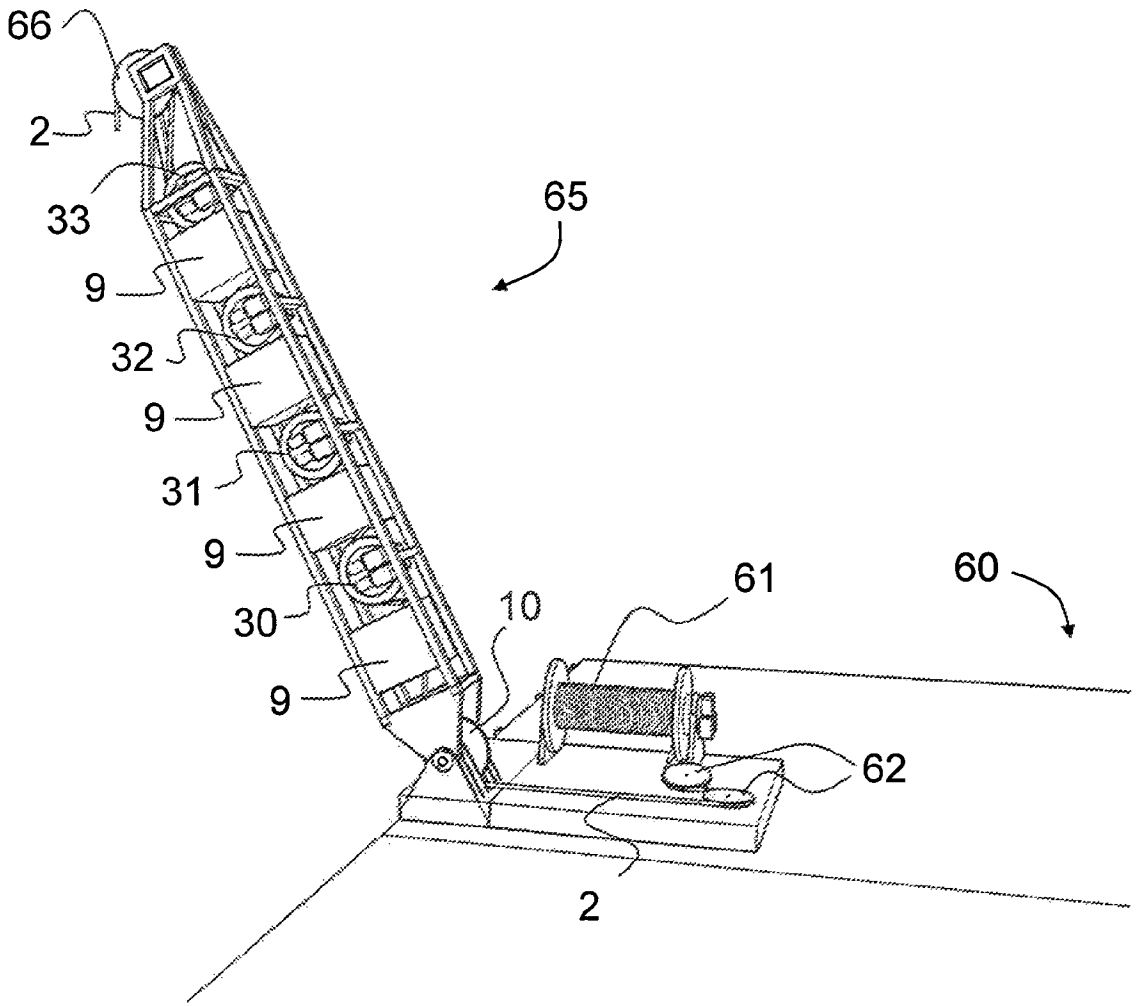
FIG. 12 schematically shows a crane including a traction device according to the invention.

FIG. 12 shows a crane including a traction device according to the invention. The crane 65 is provided on a vessel 60. The crane 65 includes a traction device 1, more specifically a traction device 1 with a linear setup. The traction device 1 includes five active rotation sheaves 10, 30, 31, 32, 33. Four line controllers 9 are positioned between neighbouring active rotation sheaves 10, 30, 31, 32, 33. The wire 2 is fed from a storage winch 61 via passive rotation sheaves 62 into the crane 65. In the crane 65, the line 2 passes the various active rotation sheaves 10, 30, 31, 32, 33 and the line controllers 9 until the line 2 reaches a passive rotation sheave 66 located in the top of the crane and configured to guide the line 2 downwards.

The following clauses are offered as a further description of the traction device and method:

1. Traction device (1) for paying out and retrieving a flexible line (2), said traction device comprising a line mover (3) wherein:
   - the line mover comprises at least one movable friction surface (4);
   - the at least one friction surface in total defines at least two arc sections (5, 6) configured to move the line along with said arc sections (5, 6);
   - in use the line is wound around said at least one friction surface such that the line comprises a first contact area (7) being in contact with the first arc section (5) and a second contact area (8) being in contact with the second arc section (6); and
   - the traction device comprises a line controller (9) coupled to the line between the first contact area and the second contact area and configured to control the velocity ($v_3$) with which the line in use is fed to the second arc section.
2. Traction device according to clause 1, wherein the line controller is configured to control the velocity ($v_3$) with which the line in use is fed to the second arc section for compensating a strain of the line.
3. Traction device according to any of the preceding clauses, wherein the line controller is configured to control the velocity ($v_3$) with which the line in use is fed to the second arc section for compensating a strain of the line occurring during a passing of the first arc section.
4. Traction device according to any of the preceding clauses, wherein the line controller is configured to feed the line to the second arc section with a velocity ($v_3$) which differs from the velocity ($v_2$) with which the line is discharged from the first arc section.

5. Traction device according to any of the preceding clauses, wherein the line controller is configured to feed the line to the second arc section with a velocity ($v_3$) which is lower than the velocity ($v_2$) with which the line is discharged from the first arc section.
6. Traction device according to any of the preceding clauses, wherein the line controller is configured to adjust the velocity ($v_3$) with which the line is in use fed to the second arc section to the velocity with which said second arc section moves.
7. Traction device according to any of the preceding clauses, wherein the line controller is configured to adjust the velocity ($v_3$) with which the line in use is fed to the second arc section such that said velocity ($v_3$) is between 95% and 105% of the velocity with which said second arc section moves.
8. Traction device according to any of the clauses 1-6, wherein the line controller is configured to adjust the velocity ($v_3$) with which the line in use is fed to the second arc section such that said velocity ($v_3$) is between 99% and 101% of the velocity with which said second arc section moves.
9. Traction device according to any of the clauses 1-6, wherein the line controller is configured to adjust the velocity ($v_3$) with which the line in use is fed to the second arc section such that said velocity ($v_3$) is between 99.5% and 100.5% of the velocity with which said second arc section moves.
10. Traction device according to any of the preceding clauses, wherein the line controller is configured to substantially equalize the velocity ($v_3$) with which the line in use is fed to the second arc section to the velocity with which said second arc section moves.
11. Traction device according to any of the preceding clauses, wherein the line controller is configured to control a length ($L_1$) of the line extending between the first contact area and the second contact area.
12. Traction device according to any of the preceding clauses, wherein the line controller is configured to adjust a length ($L_1$) of the line extending between the first contact area and the second contact area.
13. Traction device according to any of the preceding clauses, wherein the line controller is configured to increase a length ($L_1$) of the line extending between the first contact area and the second contact area.
14. Traction device according to any of the preceding clauses, wherein the line controller (9) is configured to exert such a force to the part of the line (2) extending between the first contact area (7) and the second contact area (8) that the line (2) at the first contact area (7) and second contact area (8) does substantially not slip over the first arc section (5) and the second arc section (6), respectively.
15. Traction device according to any of the preceding clauses, wherein line controller (9) is configured to control the stress in the part of the line extending between the first contact area (7) and the second contact area (8).
16. Traction device according to any of the preceding clauses, wherein:
    the part of the line (2) extending between the first contact area (7) and the line controller (9) is an incoming line (41);
    the part of the line (2) extending between the second contact area (8) and the line controller (9) is an outgoing line (42); and
    the line controller (9) is configured to maintain the stress in the outgoing line (42) ($t_3$) substantially equal to the stress in the incoming line ($t_2$).
17. Traction device according to any of the preceding clauses, wherein the line controller comprises a movable weight member coupled to line between the first contact area and the second contact area.
18. Traction device according to any of the preceding clauses, wherein the line controller comprises:
    a movable passive rotation sheave coupled to line between the first contact area and the second contact area;
    a rotation sheave mover for moving the passive rotation sheave; and
    a rotation sheave control for controlling the movement of passive rotation sheave.
19. Traction device according to clause 18, wherein the rotation sheave mover comprises one or more hydraulic cylinders.
20. Traction device according to any of the preceding clauses, wherein the line mover comprises a rotatable mounted rotation drum and the circumference of said rotation drum forms one friction surface defining at least two arc sections.
21. Traction device according to clause 20, wherein the rotation drum has a conical shape.
22. Traction device according to any of the preceding clauses, wherein the line mover comprises at least two rotatable mounted active rotation sheaves and the circumference of each of said active rotation sheaves forms one friction surface defining at least one arc section.
23. Traction device according to clause 22, wherein in use the active rotation sheaves rotate with substantially the same speed.
24. Traction device according to clause 22 or 23, wherein the active rotation sheaves are centrally driven in a rotary manner.
25. Traction device (1) according to any of the preceding clauses, wherein:
    the at least one friction surface defines a third arc section (25) configured to move the line along with said third arc section (25);
    in use the line is wound around said at least one friction surface such that the line comprises a third contact area (26) being in contact with the third arc section (25); and
    the line controller (9) is coupled to the line between the second contact area (8) and the third contact area (26) and configured to control the velocity ($v_s$) with which the line in use is fed to the third arc section (25).
26. Traction device (1) for paying out and retrieving a flexible line (2), said traction device comprising a line mover (3) wherein:
    the line mover comprises at least one movable friction surface (4);
    the at least one friction surface in total defines at least three arc sections (5, 6, 25) configured to move the line along with said arc sections (5, 6, 25);
    in use the line is wound around said at least one friction surface such that the line comprises a first contact area (7) being in contact with the first arc section (5), a second contact area (8) being in contact with the second arc section (6) and a third contact area (26) being in contact with the third arc section (25); and
    the traction device comprises a line controller (9) coupled to the line between the first contact area and the second contact area and between the second contact area and the third contact area, which line controller (9) is configured to control the velocity ($v_3$) with which the line in use is fed to the second arc section and the velocity ($v_5$) with which the line in use is fed to the third arc section (25).
27. Traction device according to clause 26, comprising one or any combination of the features of any of the clauses 2-24.

28. Traction device according to any of the clauses 25-27, wherein the line controller is configured to control the velocity ($v_3$) with which the line in use is fed to the second arc section and the velocity ($v_5$) with which the line in use is fed to the third arc section independent from each other.
29. Traction device according to any of the preceding clauses, wherein the arc sections (5, 6, 25) are centrally driven.
30. Hoisting system comprising a traction device according to any of the preceding clauses.
31. Vessel comprising a traction device according to any of clauses 1-29.
32. Crane comprising a traction device according to any of clauses 1-29.
33. Use of a traction device according to any of the clauses 1-29.
34. Use of a hoisting system according to clause 30.
35. Use of a vessel according to clause 31.
36. Use of a crane according to clause 32.
37. Method of paying out and retrieving a flexible line (2) with a traction device comprising a line mover (3) wherein:
    the line mover comprises at least one movable friction surface (4);
    the at least one friction surface in total defines at least two arc sections (5, 6) configured to move the line along with said arc sections (5, 6);
    the line is wound around said at least one friction surface such that the line comprises a first contact area (7) being in contact with the first arc section (5) and a second contact area (8) being in contact with the second arc section (6);
    the traction device comprises a line controller (9) coupled to the line between the first contact area and the second contact area; and
    the method comprises controlling the velocity ($v_3$) with which the line is fed to the second arc section by the line controller (9).
38. Method according to clause 37, wherein method comprises controlling the velocity ($v_3$) with which the line is fed to the second arc section by the line controller for compensating a strain of the line.
39. Method according to clause 37 or 38, wherein the method comprises controlling the velocity ($v_3$) with which the line is fed to the second arc section by the line controller for compensating a strain of the line occurring during a passing of the arc section.
40. Method according to any of the clauses 37-39, wherein the method comprises feeding the line to the second arc section by the line controller with a velocity ($v_3$) which differs from the velocity ($v_2$) with which the line is discharged from the first arc section.
41. Method according to any of the clauses 37-40, wherein the method comprises feeding the line to the second arc section by the line controller with a velocity ($v_3$) which is lower than the velocity ($v_2$) with which the line is discharged from the first arc section.
42. Method according to any of the clauses 37-41, wherein the method comprises adjusting the velocity ($v_3$) with which the line is fed by the line controller to the second arc section to the velocity with which said second arc section moves.
43. Method according to any of the clauses 37-42, wherein the method comprises adjusting the velocity ($v_3$) with which the line is fed by the line controller to the second arc section such that said velocity ($v_3$) is between 95% and 105% of the velocity with which said second arc section moves.
44. Method according to any of the clauses 37-42, wherein the method comprises adjusting the velocity ($v_3$) with which the line is fed by the line controller to the second arc section such that said velocity ($v_3$) is between 99% and 101% of the velocity with which said second arc section moves.
45. Method according to any of the clauses 37-42, wherein the method comprises adjusting the velocity ($v_3$) with which the line is fed by the line controller to the second arc section such that said velocity ($v_3$) is between 99.5% and 100.5% of the velocity with which said second arc section moves.
46. Method according to any of the clauses 37-45, wherein the method comprises substantially equalizing the velocity ($v_3$) with which the line is fed by the line controller to the second arc section to the velocity with which said second arc section moves.
47. Method according to any of the clauses 37-46, wherein the method comprises controlling a length ($L_1$) of the line extending between the first contact area and the second contact area with the line controller.
48. Method according to any of the clauses 37-47, wherein the method comprises adjusting a length ($L_1$) of the line extending between the first contact area and the second contact area with the line controller.
49. Method according to any of the clauses 37-48, wherein the method comprises increasing a length ($L_1$) of the line extending between the first contact area and the second contact area with the line controller.
50. Method according to any of the clauses 37-49, wherein the method comprises exerting such a force with the line controller (9) to the part of the line (2) extending between the first contact area (7) and the second contact area (8) that the line (2) at the first contact area (7) and second contact area (8) does substantially not slip over the first arc section (5) and the second arc section (6), respectively.
51. Method according to any of the clauses 37-50, wherein the method comprises controlling the stress in the part of the line extending between the first contact area (7) and the second contact area (8) with the line controller (9).
52. Method according to any of the clauses 37-51, wherein:
    the part of the line (2) extending between the first contact area (7) and the line controller (9) is an incoming line (41);
    the part of the line (2) extending between the second contact area (8) and the line controller (9) is an outgoing line (42); and
    the method comprises maintaining the stress in the outgoing line (42) ($t_3$) substantially equal to the stress in the incoming line ($t_2$) with the line controller (9).
53. Method according to any of the clauses 37-52 wherein the flexible line is paid out or retrieved with a traction device according to any of the clauses 1-29.
54. Method according to any of the clauses 37-53, wherein:
    the at least one friction surface defines a third arc section (25) configured to move the line along with said third arc section (25);
    the line is wound around said at least one friction surface such that the line comprises a third contact area (26) being in contact with the third arc section (25);
    the line controller (9) is coupled to the line between the second contact area (8) and the third contact area (26); and
    the method comprises controlling the velocity ($v_5$) with which the line is fed to the third arc section by the line controller (9).
55. Method of paying out and retrieving a flexible line (2) with a traction device comprising a line mover (3) wherein:
    the line mover comprises at least one movable friction surface (4);

the at least one friction surface in total defines at least three arc sections (5, 6, 25) configured to move the line along with said arc sections (5, 6, 25);

the line is wound around said at least one friction surface such that the line comprises a first contact area (7) being in contact with the first arc section (5), a second contact area (8) being in contact with the second arc section (6) and a third contact area (26) being in contact with the third arc section (25);

the traction device comprises a line controller (9) coupled to the line between the first contact area and the second contact area and between the second contact area and the third contact area; and the method comprises controlling the velocity ($v_3$) with which the line is fed to the second arc section and the velocity ($v_5$) with which the line is fed to the third arc section by the line controller (9).

56. Method according to clause 55, comprising one or any combination of the features of any of the clauses 38-53.

57. Method according to any of the clauses 54-56, comprising controlling the velocity ($v_3$) with which the line in use is fed to the second arc section and the velocity ($v_5$) with which the line in use is fed to the third arc section independently from each other.

58. Method according to any of the clauses 37-57, comprising driving the arc sections (5, 6, 25) centrally.

The invention claimed is:

1. A traction device for paying out and retrieving a flexible line, said traction device comprising a line mover wherein:

the line mover comprises at least one movable friction surface;

the at least one friction surface in total defines at least two arc sections configured to move the line along with said arc sections;

in use the line is wound around said at least one friction surface such that the line comprises a first contact area being in contact with the first arc section and a second contact area being in contact with the second arc section; and the traction device comprises a line controller coupled to the line between the first contact area and the second contact area as seen along that part of the line between the first contact area and the second contact area, and configured to control a velocity ($v_3$) with which the line in use is fed to the second arc section, wherein the velocity ($v_3$) with which the line is fed to the second arc section is adjusted to a second arc section velocity with which said second arc section moves for compensating a first arc section strain of the line occurring during a passing of the first arc section, the line controller being configured to adjust the length of the part of the line extending between the first contact area and the second contact area.

2. The traction device according to claim 1, wherein the line controller is configured to control the velocity ($v_3$) with which the line in use is fed to the second arc section for compensating the first arc section strain of the line.

3. The traction device according to claim 1, wherein the line controller is configured such that the velocity ($v_3$) with which the line is fed to the second arc section differs from a velocity ($v_2$) with which the line is discharged from the first arc section.

4. The traction device according to claim 1, wherein the line controller is configured to adjust the velocity ($v_3$) with which the line is in use fed to the second arc section to the second arc section velocity with which said second arc section moves.

5. The traction device according to claim 1, wherein the line controller is configured to exert such a force to a part of the line extending between the first contact area and the second contact area that the line at the first contact area and second contact area does not slip over the first arc section and the second arc section, respectively.

6. The traction device according to claim 1, wherein the line controller comprises a movable weight member coupled to line between the first contact area and the second contact area.

7. The traction device according to claim 1, wherein the line controller comprises:

a movable passive rotation sheave coupled to line between the first contact area and the second contact area;

a rotation sheave mover for moving the passive rotation sheave; and a rotation sheave control for controlling the movement of passive rotation sheave.

8. The traction device according to claim 7, wherein the rotation sheave mover comprises one or more hydraulic cylinders.

9. A traction device for paying out and retrieving a flexible line, said traction device comprising a line mover wherein:

the line mover comprises at least one movable friction surface;

the at least one friction surface in total defines at least three arc sections configured to move the line along with said arc sections;

in use the line is wound around said at least one friction surface such that the line comprises a first contact area being in contact with the first arc section, a second contact area being in contact with the second arc section and a third contact area being in contact with the third arc section; and the traction device comprises a line controller coupled to the line between the first contact area and the second contact area as seen along that part of the line between the first contact area and the second contact area, and between the second contact area and the third contact area as seen along that part of the line between the second contact area and the third contact area, which line controller is configured to control a velocity ($v_3$) with which the line in use is fed to the second arc section and a velocity ($v_5$) with which the line in use is fed to the third arc section, wherein the velocity ($v_3$) with which the line is fed to the second arc section is adjusted to a second arc section velocity with which said second arc section moves for compensating a first arc section strain of the line occurring during a passing of the first arc section and the velocity ($v_5$) with which the line is fed to the third arc section is adjusted to a third arc section velocity with which said third arc section moves for compensating a second arc section strain of the line occurring during a passing of the second arc section, the line controller being configured to adjust the length of the part of the line extending between the first contact area and the second contact area and to adjust the length of the part of the line extending between the second contact area and the third contact area.

10. The traction device according to claim 9, wherein the arc sections are centrally driven in unison at a same rotational rate.

11. The traction device according to claim 9, wherein the line controller adjusts the length of the line extending between the first contact area and the second contact area and the length of the line extending between the second contact area and the third contact area independent from each other.

12. A method of paying out and retrieving a flexible line with a traction device comprising a line mover wherein:

the line mover comprises at least one movable friction surface;

the at least one friction surface in total defines at least two arc sections configured to move the line along with said arc sections;

the line is wound around said at least one friction surface such that the line comprises a first contact area being in contact with the first arc section and a second contact area being in contact with the second arc section;

the traction device comprises a line controller coupled to the line between the first contact area and the second contact area as seen along that part of the line between the first contact area and the second contact area; and the method comprises controlling a velocity ($v_3$) with which the line is fed to the second arc section by the line controller, wherein the velocity ($v_3$) with which the line is fed to the second arc section is adjusted to a second arc section velocity with which said second arc section moves for compensating a first arc section strain of the line occurring during a passing of the first arc section; and adjusting the length of the part of the line extending between the first contact area and the second contact area with the line controller.

13. The method according to claim 12, wherein method comprises controlling the velocity ($v_3$) with which the line is fed to the second arc section by the line controller for compensating the first arc section strain of the line.

14. The method according to claim 12, wherein the velocity ($v_3$) with which the line is fed to the second arc section by the line controller differs from a velocity ($v_2$) with which the line is discharged from the first arc section.

15. The method according to claim 12, wherein the method comprises adjusting the velocity ($v_3$) with which the line is fed by the line controller to the second arc section to the second arc section velocity with which said second arc section moves.

16. The method according to claim 12, wherein the method comprises exerting such a force with the line controller to a part of the line extending between the first contact area and the second contact area that the line at the first contact area and second contact area does not slip over the first arc section and the second arc section, respectively.

17. A method of paying out and retrieving a flexible line with a traction device comprising a line mover wherein:

the line mover comprises at least one movable friction surface;

the at least one friction surface in total defines at least three arc sections configured to move the line along with said arc sections;

the line is wound around said at least one friction surface such that the line comprises a first contact area being in contact with the first arc section, a second contact area being in contact with the second arc section and a third contact area being in contact with the third arc section;

the traction device comprises a line controller coupled to the line between the first contact area and the second contact area as seen along that part of the line between the first contact area and the second contact area, and between the second contact area and the third contact area as seen along that part of the line between the second contact area and the third contact area; and the method comprises controlling a velocity ($v_3$) with which the line is fed to the second arc section and a velocity ($v_5$) with which the line is fed to the third arc section by the line controller, wherein the velocity ($v_3$) with which the line is fed to the second arc section is adjusted to a second arc section velocity with which said second arc section moves for compensating a first arc section strain of the line occurring during a passing of the first arc section and the velocity ($v_5$) with which the line is fed to the third arc section is adjusted to a third arc section velocity with which said third arc section moves for compensating a second arc section strain of the line occurring during a passing of the second arc section;

adjusting the length of the part of the line extending between the first contact area and the second contact area with the line controller; and adjusting the length of the part of the line extending between the second contact area and the third contact area with the line controller.

18. The method according to claim 17, comprising driving the arc sections centrally in unison at a same rotational rate.

19. The method according to claim 17, wherein the length of the line extending between the first contact area and the second contact area and the length of the line extending between the second contact area and the third contact area are adjusted independent from each other.

* * * * *